US005134964A

United States Patent [19]

Masters

[11] Patent Number: 5,134,964

[45] Date of Patent: Aug. 4, 1992

[54] FLEXIBLE SECURITY LOOP FOR KAYAKS

[76] Inventor: William E. Masters, 313 Dogwood La., Easley, S.C. 29640

[21] Appl. No.: 636,245

[22] Filed: Dec. 31, 1990

[51] Int. Cl.[5] ..... B63B 35/00

[52] U.S. Cl. ..... 114/347; 114/218; 114/364; 24/265 CD

[58] Field of Search ..... 114/218, 230, 347, 249, 114/343, 364; 410/104, 105, 116; 24/115 K, 265 CD; 441/74

[56] References Cited

U.S. PATENT DOCUMENTS 3,126,859 3/1964 Bigelow ..... 114/218
3,765,365 10/1973 Gillespie ..... 114/218

*Primary Examiner*—Edwin L. Swinehart
*Attorney, Agent, or Firm*—Cort Flint

[57] ABSTRACT

A flexible security loop (A) for a flexible kayak hull (12) is disclosed which includes a flexible vinyl covered strand (16) having enlarged ends (34, 36) which fit through an enlarged center opening (32) of a bracket slot (30) to interlock at slot ends (26, 28), and attach the strand to the hull in the form of flexible loop (A).

20 Claims, 2 Drawing Sheets

FLEXIBLE SECURITY LOOP FOR KAYAKS

BACKGROUND OF THE INVENTION

The invention relates to a flexible security loop and method for attaching the same to a flexible structure like the hull of a kayak.

White water boating using kayaks has become increasingly popular. White water kayaks are typically constructed from a flexible plastic skin to yield upon impact with the water and various obstacles encountered in white water conditions. The hull is formed from flexible plastic material, such as high density polyethylene plastic, and a supporting framework is necessary to maintain the configuration and structural integrity of the boat under forces of impact with the water and obstacles such as rocks encountered. Frame elements have been constructed from solid foam blocks to absorb part of the impact such as disclosed in U.S. Pat. No. 4,681,060; and from hollow frame elements such as disclosed in U.S. Pat. No. 4,227,272.

One of the problems encountered with flexible skin kayaks is in making attachment to the hull. In particular, making attachment of hardware items to the hull is difficult due to the flexible skin construction. In some situations, it is necessary to lift or pull the kayak under considerable force, and without an adequate attachment to the hull, this becomes extremely difficult. For example, it is not unusual in white water kayaking, the kayak often becomes lodged between rocks, either under or above water. The kayak typically fills with water and it is very difficult to remove the kayak as it is wedged in the rocks due to the force of rushing water. Ropes made into the form of loops have been threaded through openings in the kayak hull, however, these are not able to withstand the forces necessary to pull a wedged kayak from the rocks.

Accordingly, an important object of the present invention is to provide a device and method for attachment to a flexible hull of a kayak by which a considerable force may be imparted to the kayak through the attachment.

Another object of the invention is to provide a device and method for attachment to the flexible hull of a kayak of a loop which can accommodate large pulling forces yet is flexible to minimize personal injury and damage to the kayak in the event of impact.

SUMMARY OF THE INVENTION

The above objectives are accomplished according to the present invention by combining a flexible hull with a flexible security loop which comprises a generally rigid bracket plate disposed on an underneath side of the hull. An elongated flexible element is curved in the form of a loop having first and second ends which extend through the hull. Enlargements are carried by the first and second ends of the elongated flexible element. The elongated flexible element consists of a vinyl covered flexible wire cable. A complimentary fastener preferably includes an elongated slot which is formed in the bracket plate and includes first and second slot ends which are engaged by the enlargements of the first and second ends of the elongated flexible element. A first enlargement carried by the first end of the elongated flexible element and a second enlargement carried by the second end of the elongated flexible element. The elongated slot formed in the bracket plate generally includes an enlarged center opening corresponding in shape to the first and second enlargements for receiving the enlargements one at a time. The slot is reduced in dimension relative to the first and second enlargements whereby the first and second enlargements project beyond the slot to laterally engage the bracket plate whereby the force exerted on the loop formed by the elongated flexible element is transmitted to the rigid bracket plate for reinforcement. The first and second enlargements preferably include bulbous elements which are carried on the first and second ends of the elongated flexible element.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Referring now in more detail to the drawings, a kayak 10 having a flexible hull 12 is illustrated which includes a flexible security loop A. Hull 12 is formed, such as by rotational molding, from a suitable polymeric material such as a cross-link polyethylene.

Figure 1:
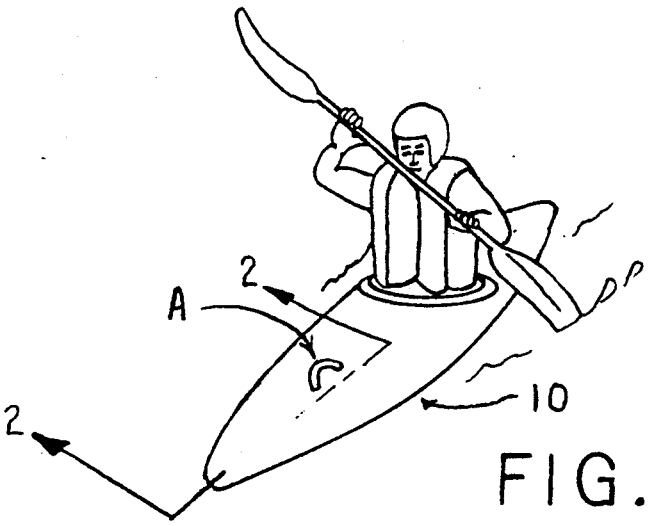
FIG. 1 is a perspective view of a kayak having a flexible loop according to the invention.
Figure 2:
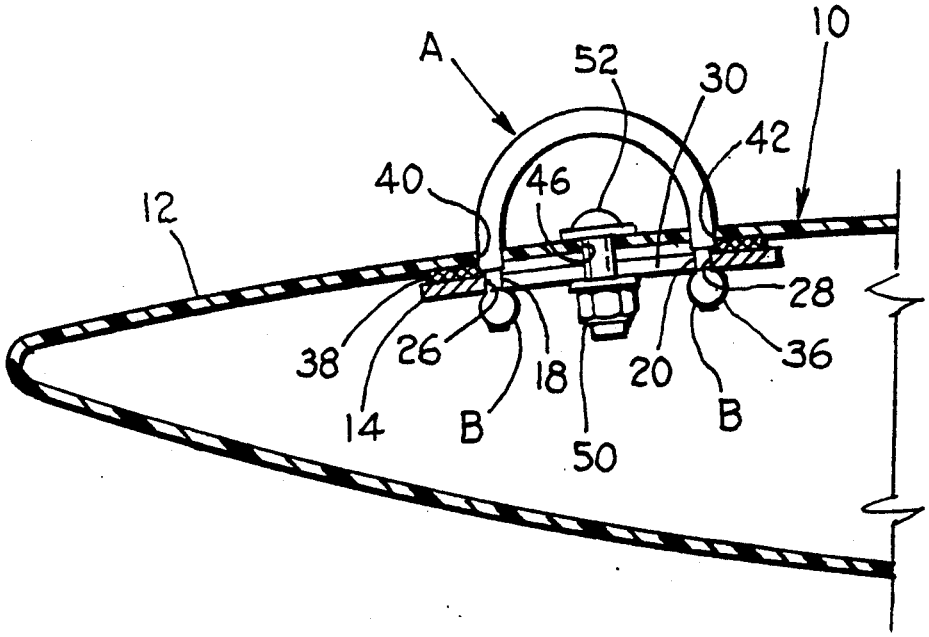
FIG. 2 is a sectional view taken along line 2—2 of FIG. 1.

As can best be seen in FIG. 2, flexible loop A includes a generally rigid bracket plate 14 disposed on an underneath side of hull 12. An elongated flexible element 16 curved in the form of a loop has first and second ends 18 and 20 which extend through hull 12. Fastening means 22 is provided for securing first and second ends 18, 20 of elongated flexible element 16 into bracket plate 14 at spaced apart locations. Elongated flexible element 16 preferably includes an elongated flexible strand such as a wire cable having a vinyl coating 24. The spaced apart fastening means include first and second slot ends 26, 28 of an elongated slot 30 in which first and second ends 18, 20 of elongated flexible element 16 are attached. Slot 30 includes an enlarged center opening 32 corresponding generally in shape by a first enlargement 34 and a second enlargement 36 carried by first and second ends 18, 20 of elongated flexible strand 16. Slot 30 is reduced in dimension relative to the enlargements of elongated flexible strand 16 whereby the enlargements project laterally beyond slot 30 to engage bracket plate 14 whereby the force exerted on loop A formed by the elongated flexible element is transmitted to rigid bracket plate 14 for reinforcement. A resilient layer 38 is disposed between bracket plate 14 and hull 12 which forms a seal therebetween.

The complimentary fastening means includes elongated slot 30 formed in bracket plate 14 and spaced apart first and second slot ends 26, 28 of slot 30 engaged by enlarged attachment means B of first and second ends 18, 20 of elongated flexible element 16. Enlarged center opening 32 corresponds generally in shape to enlarged attachment means B of elongated flexible element 16. Preferably, enlarged attachment means B comprises first enlarged bulb 34 carried by first end 18 of elongated flexible element 16 and second enlarged bulb 36 carried by second end 20 of elongated flexible element 16. Bulbs 34, 36 may be advantageously provided by metal beads mechanically secured to a wire cable, such as by swaging and the like. Enlarged center opening 32 corresponds generally in shape to the first and second enlarged bulbs.

Figure 3:
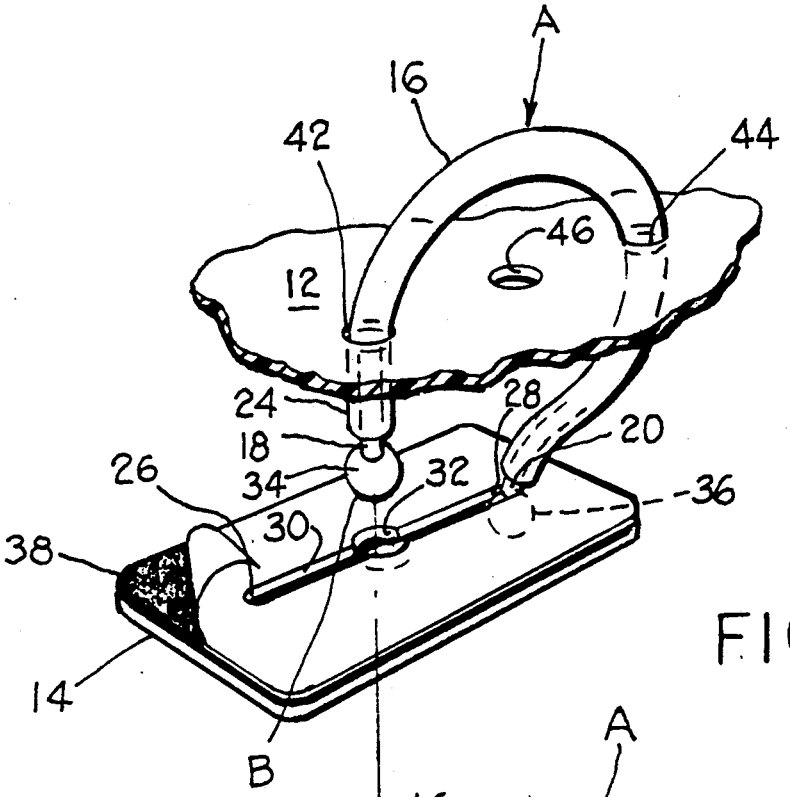
FIG. 3 is a perspective view illustrating a method for attaching a flexible loop to a kayak according to the invention.
Figure 4:
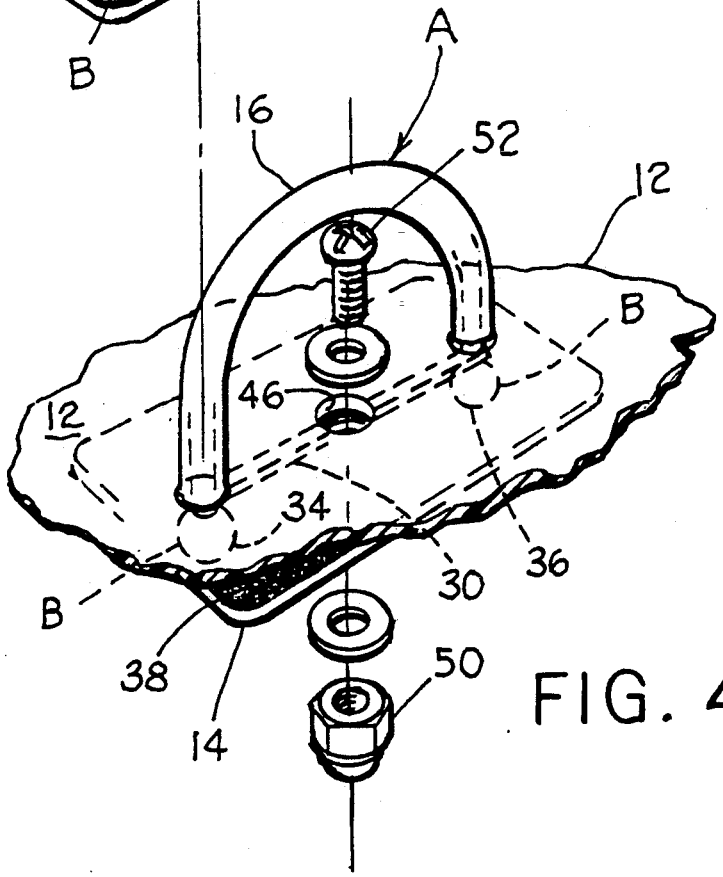
FIG. 4 is a perspective view illustrating a flexible loop and method of attachment to a flexible kayak hull according to the invention.

A method for attaching flexible security loop A to a kayak 10 and the like will now be described with reference to FIGS. 3 and 4. The method comprises forming at least a first and second opening 40, 42 in skin of kayak hull 12 at spaced apart locations. Next, an enlarged end 34, 36 of elongated flexible strand 16 is extended through one of the openings 40, 42, and rigid bracket plate 14 is placed beneath hull 12. One enlarged end of flexible strand 16 is inserted through enlarged opening 32 of bracket slot 30, and the enlarged end is moved to the second slot end 28 of slot 30 (FIG. 3). Next, the other enlarged end 34 of flexible strand 16 is placed through enlarged opening 32 of bracket slot 30 and the enlarged end is moved to first end 26 of bracket slot 30 (FIG. 4). Finally, bracket 14 may be secured to hull 12 by a nut 50 and bolt 52 inserted through a third hull opening 46. Optionally, a resilient gasket 38 is sandwiched between plate 14 and hull 12.

While a preferred embodiment of the invention has been described using specific terms, such description is for illustrative purposes only, and it is to be understood that changes and variations may be made without departing from the spirit or scope of the following claims.

What is claimed is:

1. In combination with a kayak having a flexible hull, a flexible security loop comprising:

a generally rigid bracket plate disposed on an underneath side of said hull;

an elongated flexible element curved in the form of a loop having first and second ends extending through said hull;

enlarged attachment means carried by said first and second ends of said elongated flexible element;

spaced apart complimentary fastening means included on said bracket plate for receiving said enlarged attachment means for securing said elongated flexible element to said bracket plate at spaced apart locations; and said elongated flexible element consists of an elongated pliant strand which is non-rigid and is freely bendable to yield upon impact.

2. The device of claim 1 wherein said elongated flexible strand includes a flexible wire cable having a vinyl coating.

3. The device of claim 1 wherein said complimentary fastening means includes an elongated slot formed in said bracket plate and said spaced apart locations include first and second slot ends of said slot engaged by said enlarged attachment means of said first and second ends of said elongated flexible element.

4. The device of claim 3 wherein said bracket slot includes an enlarged center opening corresponding generally in shape to said enlarged attachment means of said first and second ends of said elongated flexible element.

5. The device of claim 1 including fastener means for fastening said bracket plate to said flexible hull of said kayak.

6. The device of claim 5 wherein said bracket plate comprises a center opening, and said fastener means includes a fastener which extends through said flexible hull and said center opening and a locking member which secures said fastener, flexible hull, and bracket plate together.

7. The device of claim 1 wherein said enlarged attachment means comprises a first enlargement carried by said first end of said elongated flexible element and a second enlargement carried by said second end of said elongated flexible element.

8. The device of claim 7 wherein said complimentary fastening means comprises an elongated slot formed in said bracket plate, said slot having an enlarged center opening corresponding generally in shape to said first and second enlargements for receiving each said enlargement one at a time, and said slot being reduced in dimension relative to said first and second enlargements whereby said first and second enlargements project beyond said slot to laterally engage said bracket plate whereby a force exerted on said loop formed by said elongated flexible element is transmitted to said rigid bracket plate for reinforcement.

9. The device of claim 7 wherein said first and second enlargements include bulbous elements carried on said first and second ends of said elongated flexible element.

10. The device of claim 1 including a resilient layer disposed between said bracket plate and said hull which forms a seal therebetween.

11. The device of claim 10 wherein said resilient layer is adhesive.

12. The device of claim 1 including second fastening means fastening said bracket plate to said hull.

13. In combination with a kayak having a flexible hull, a flexible security loop comprising:

a generally rigid bracket plate disposed on an underneath side of said hull;

an elongated flexible element curved in the form of a loop having first and second ends extending through said hull;

spaced apart fastening means for securing said first and second ends of said elongated flexible element to said bracket plate at spaced apart locations; and said fastening means including spaced apart openings formed in said bracket plate and said spaced apart openings include first and second slot ends of an elongated slot and said fastening means securing said first and second ends of said elongated flexible element in said openings.

14. The device of claim 13 wherein said elongated flexible element comprises an elongated flexible strand having a vinyl coating.

15. The device of claim 13 wherein said slot includes an enlarged center opening corresponding generally in shape to said first and second ends of said elongated flexible element, and said slot being reduced in dimension relative to said first and second ends of said elongated flexible element whereby said ends project laterally beyond said slot to engage said bracket plate whereby a force exerted on said loop formed by said elongated flexible element is transmitted to said rigid bracket plate for reinforcement.

16. The device of claim 13 including a resilient layer disposed between said bracket plate and said hull which forms a seal therebetween.

17. The device of claim 13 including second fastening means fastening said bracket plate to said hull.

18. A method for attaching a flexible security loop to a kayak comprising:

forming at least a first and second opening in a hull of said kayak at spaced apart locations;

extending a first enlarged end of an elongated flexible strand through said first opening and extending a second enlarged end of said flexible strand through its said second opening;

placing a rigid bracket plate having an elongated bracket slot with an enlarged opening beneath the hull of said kayak;

placing said first enlarged end of said flexible strand through said enlarged opening of the bracket slot and moving said first enlarged end to a first slot end of said slot;

placing said enlarged second end of said flexible strand through said enlarged opening of said bracket slot and moving said second enlarged end to a second enlarged end to a second end of said bracket slot; and securing said bracket to said hull.

19. The method of claim 18 including fastening bracket plate to said flexible hull of said kayak by a fastener inserted through said enlarged opening of said bracket slot.

20. The method of claim 18 including placing a resilient layer between said bracket plate and said hull.

* * * * *